US008383035B2

(12) United States Patent
Kim et al.

(10) Patent No.: US 8,383,035 B2
(45) Date of Patent: Feb. 26, 2013

(54) REMOVING METHOD OF SMELLS

(75) Inventors: Pyoung-Hwan Kim, Busan (KR); Young-Soo Kim, Changwon-shi (KR)

(73) Assignee: LG Electronics Inc., Seoul (KR)

( * ) Notice: Subject to any disclaimer, the term of this patent is extended or adjusted under 35 U.S.C. 154(b) by 355 days.

(21) Appl. No.: 12/668,128

(22) PCT Filed: Jul. 10, 2007

(86) PCT No.: PCT/KR2007/003344
§ 371 (c)(1),
(2), (4) Date: Jan. 7, 2010

(87) PCT Pub. No.: WO2009/008560
PCT Pub. Date: Jan. 15, 2009

(65) Prior Publication Data

US 2010/0322819 A1 Dec. 23, 2010

(51) Int. Cl.

| | |
|---|---|
| ***A61L 9/00*** | (2006.01) |
| *A62B 7/08* | (2006.01) |
| *A61L 2/00* | (2006.01) |
| *F26B 11/02* | (2006.01) |

(52) U.S. Cl. ..... 422/5; 422/120; 422/292; 422/293; 34/595; 34/604; 34/605; 34/607

(58) Field of Classification Search ..... 422/5, 292, 422/293, 295, 298, 300, 120; 34/595, 596, 34/132, 604, 605, 607; 68/5 R, 7
See application file for complete search history.

(56) References Cited

U.S. PATENT DOCUMENTS

| | | | | |
|---|---|---|---|---|
| 2,114,776 | A * | 4/1938 | Davis | 68/18 R |
| 3,089,327 | A * | 5/1963 | Stilwell, Jr. | 68/139 |
| 3,110,544 | A * | 11/1963 | Moulthrop | 8/137 |
| 5,477,623 | A * | 12/1995 | Tomizawa et al. | 34/58 |
| 5,673,497 | A * | 10/1997 | St. Louis | 34/486 |
| 2003/0233766 | A1 * | 12/2003 | Bolduan et al. | 34/335 |
| 2005/0091755 | A1 * | 5/2005 | Conrad et al. | 8/137 |
| 2006/0005581 | A1 * | 1/2006 | Banba | 68/5 R |
| 2006/0117596 | A1 * | 6/2006 | Kim et al. | 34/607 |
| 2009/0282695 | A1 * | 11/2009 | Kreutzfeldt et al. | 34/443 |

FOREIGN PATENT DOCUMENTS

| | | | |
|---|---|---|---|
| EP | 1441060 | A1 * | 7/2004 |
| EP | 1605091 | A1 | 12/2005 |
| EP | 1666 655 | | 6/2006 |
| JP | 09-000790 | | 1/1997 |
| WO | WO 2007/024050 | | 3/2007 |

OTHER PUBLICATIONS

English translation of EP 1441060 A1, 2004.*
European Search Report dated Jun. 7, 2011.
PCT International Search Report dated Aug. 28, 2009.

* cited by examiner

*Primary Examiner* — Regina M. Yoo
(74) *Attorney, Agent, or Firm* — KED & Associates, LLP

(57) ABSTRACT

A system and method of removing odors by adsorbing steam vapor and exhausting the odors by generating a forcible flow is provided. The system may include a rotatable drum for receiving items to be deodorized, a steam generator for supplying steam to the drum, and a passage for generating a forcible flow through the drum. The method may include adsorbing steam generated by the steam generator by the items to be deodorized, and exhausting the adsorbed steam using the forcible flow through the drum.

9 Claims, 9 Drawing Sheets

REMOVING METHOD OF SMELLS

TECHNICAL FIELD

The present invention relates to a removing method of smells, and more particularly, to a removing method of smells which can efficiently remove smells by adsorbing the steam or vapor to an object to be smell-removed, and exhausting the smells by generating a forcible flow.

BACKGROUND ART

In general, when bad smells permeate fibers such as sporting goods, bags, curtains, shoes, bedclothes and clothes, such smells can be removed by a washing.

The removing method of the smells which washes an object to be smell-removed can remove dirts and smells at the same time. However, if a washing is conducted on an object having not dirts but smells, it is an waste of water and detergent. In this case, a deodorant which is a kind of chemical agent is used to remove the smells.

Normally, a liquid phase deodorant is sprayed onto an object to be smell-removed at a predetermined interval of distance. The deodorant is evenly injected into the object to be smell-removed, for killing germs causing the smells permeating the fibers and removing the smells.

The removing method of the smells which sprays the deodorant onto the object to be smell-removed employs the deodorant which is a kind of chemical agent. Therefore, chemical elements contained in the deodorant may remain and affect people with weak immunity or susceptibility, such as patients. Moreover, in order to directly evenly spray the deodorant onto the object to be smell-removed, it is necessary to change a spraying direction by turning the object and to maintain a constant spraying distance.

Meanwhile, a conventional washing machine has a smell removing function. However, the conventional washing machine nothing but supplies the hot air by rotating a drum. Accordingly, there is a limit in removing smells sticking to clothes.

In addition, when supplying the hot air, the conventional washing machine mixes the objects by rotating the drum. If any object has serious smells, it produces a bad result.

As the conventional washing machine merely supplies the hot air by rotating the drum, it has difficulty in removing water soluble or fat soluble smell factors sticking to the object.

DISCLOSURE OF INVENTION

An object of the present invention is to provide a removing method of smells which can remove smells sticking to an object to be smell-removed, such as clothes.

Another object of the present invention is to provide a removing method of smells which can safely remove smells from an object to be smell-removed, such as clothes.

Yet another object of the present invention is to provide a removing method of smells which can prevent smell transfer between objects to be smell-removed, by preventing mixing of the objects.

Yet another object of the present invention is to provide a removing method of smells which can efficiently remove smells without a side effect by supplying the hot air or steam, without transferring the smells between objects.

Yet another object of the present invention is to provide a removing method of smells which can remove smells which cannot be removed by a general washing machine.

Yet another object of the present invention is to provide a removing method of smells which can improve the safety by exhausting a deodorant with smells, when the deodorant is applied to an object to be smell-removed.

In order to achieve the above-described objects of the invention, there is provided a removing method of smells using: a rotatable drum for containing an object to be smell-removed; a steam generator for supplying the steam into the drum; and a passage extended to the drum, for generating a forcible flow in the drum, the removing method of the smells, including: a first step of adsorbing the steam generated by the steam generator to the object to be smell-removed, by supplying the steam into the drum; and a second step of exhausting the adsorbed steam, by generating the forcible flow in the drum by using the passage. The forcible flow includes non-heated forcible flow and hot air (heated forcible flow), and can be generated by a forcible flow means such as a blower, a fan or a pump. The present invention is suitably applicable to a washing machine or a drying/washing machine, namely, to any apparatus provided with a drum, a forcible flow passage and a steam generator. The present invention can be embodied as part of a washing process or a separate course.

In one aspect of the present invention, in the second step, the forcible flow is generated by supplying the hot air.

In another aspect of the present invention, in at least one of the first and second steps, the rotation of the drum is accompanied. A rotation mode can be spinning (clothes are rotated in a sticking state to the drum), tumbling (clothes are rotated along the drum and dropped by the gravity), or a combination thereof.

In yet another aspect of the present invention, the second step further includes a step of removing the exhausted adsorbed steam on the passage.

In addition, there is provided a removing method of smells using: a rotatable drum for containing an object to be smell-removed; a steam generator for supplying the steam into the drum; and a passage extended to the drum, for generating a forcible flow in the drum, the removing method of the smells, including: a first step of exhausting the air from the drum, by generating the forcible flow by using the passage; a second step of adsorbing the steam generated by the steam generator to the object to be smell-removed, by supplying the steam into the drum; and a third step of removing the adsorbed steam, by generating the forcible flow in the drum by supplying the hot air by using the passage.

In one aspect of the present invention, in the first step, the forcible flow is generated by supplying the hot air.

In another aspect of the present invention, the removing method of the smells includes a fourth step of generating the forcible flow in the drum, by supplying wind having a lower temperature than a temperature of the hot air of the third step.

In yet another aspect of the present invention, the removing method of the smells further includes a fourth step of cooling the object supplied with the hot air.

In yet another aspect of the present invention, in at least one of the first to fourth steps, the rotation of the drum is accompanied.

There is also provided a removing method of smells using: a rotatable drum for containing an object to be smell-removed; and a passage extended to the drum, for supplying the hot air into the drum, the removing method of the smells, including: a first step of rotating the drum containing the objects to be smell-removed; and a second step of removing the smells from the objects without mixing the objects, by rotating the drum at an accelerating speed so that the objects can stick to the drum, the second step including a process of supplying the hot air from the passage to the drum.

In one aspect of the present invention, the second step includes, at least once, a process of rotating the drum at a decelerating speed to mix the objects.

In addition, there is provided a removing method of smells using: a rotatable drum for containing an object to be smell-removed; a steam generator for supplying the steam into the drum; and a passage extended to the drum, for generating a forcible flow in the drum, the removing method of the smells, including: a first step of removing the smells from the objects without mixing the objects, by rotating the drum so that the objects can stick to the drum, the first step including a process of adsorbing the steam generated by the steam generator to the objects, by supplying the steam into the drum; and a second step of removing the adsorbed steam, by generating the forcible flow in the drum by supplying the hot air to the passage.

In one aspect of the present invention, the second step includes a process of rotating the drum.

Moreover, there is provided a removing method of smells using: a rotatable drum for containing an object to be smell-removed; a first passage extended to the drum, for supplying a deodorant into the drum; and a second passage extended to the drum, for generating a forcible flow in the drum, the removing method of the smells, including: a first step of adsorbing the deodorant to the object to be smell-removed, by supplying the deodorant to the first passage; and a second step of removing the adsorbed deodorant and the smells, by generating the forcible flow in the drum by supplying the hot air to the second passage.

In one aspect of the present invention, the first passage is connected to a pump positioned below the drum, and the supply of the deodorant in the first step is performed by spraying the deodorant into the first passage by using the pump.

In another aspect of the present invention, the removing method of the smells includes a third step of cooling the object. The cooling can be performed by supplying non-heated wind through the second passage, or merely by rotating the drum.

In yet another aspect of the present invention, at least one of the first to third steps further includes a step of rotating the drum.

BRIEF DESCRIPTION OF THE DRAWINGS

The present invention will become better understood with reference to the accompanying drawings which are given only by way of illustration and thus are not limitative of the present invention, wherein.

BEST MODE FOR CARRYING OUT THE INVENTION

A removing method of smells in accordance with preferred embodiments of the present invention will now be described in detail with reference to the accompanying drawings.

Figure 1:
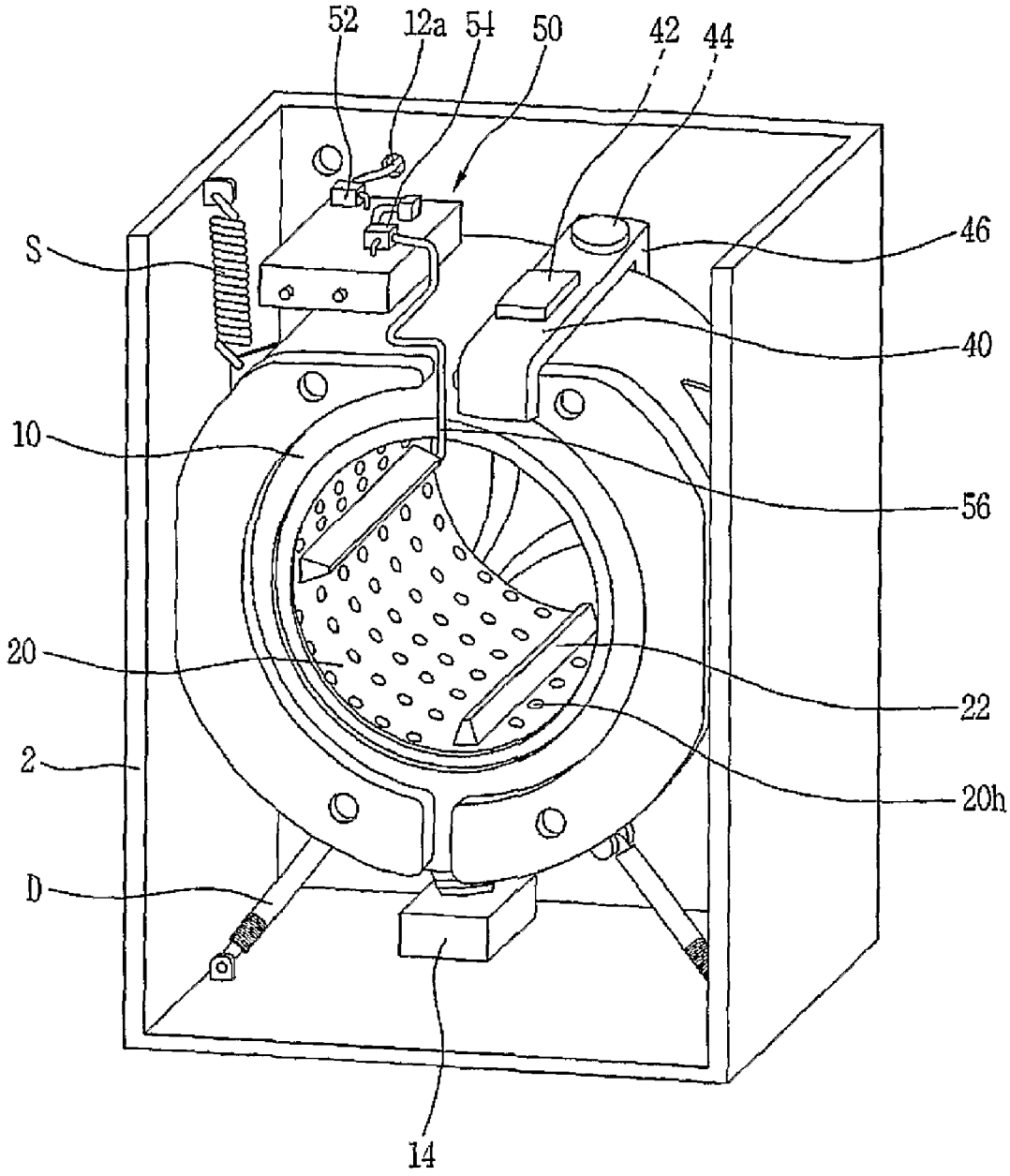
FIGS. 1 and 2 illustrate a first example of a washing machine to which a removing method of smells according to the present invention is applicable.
Figure 2:
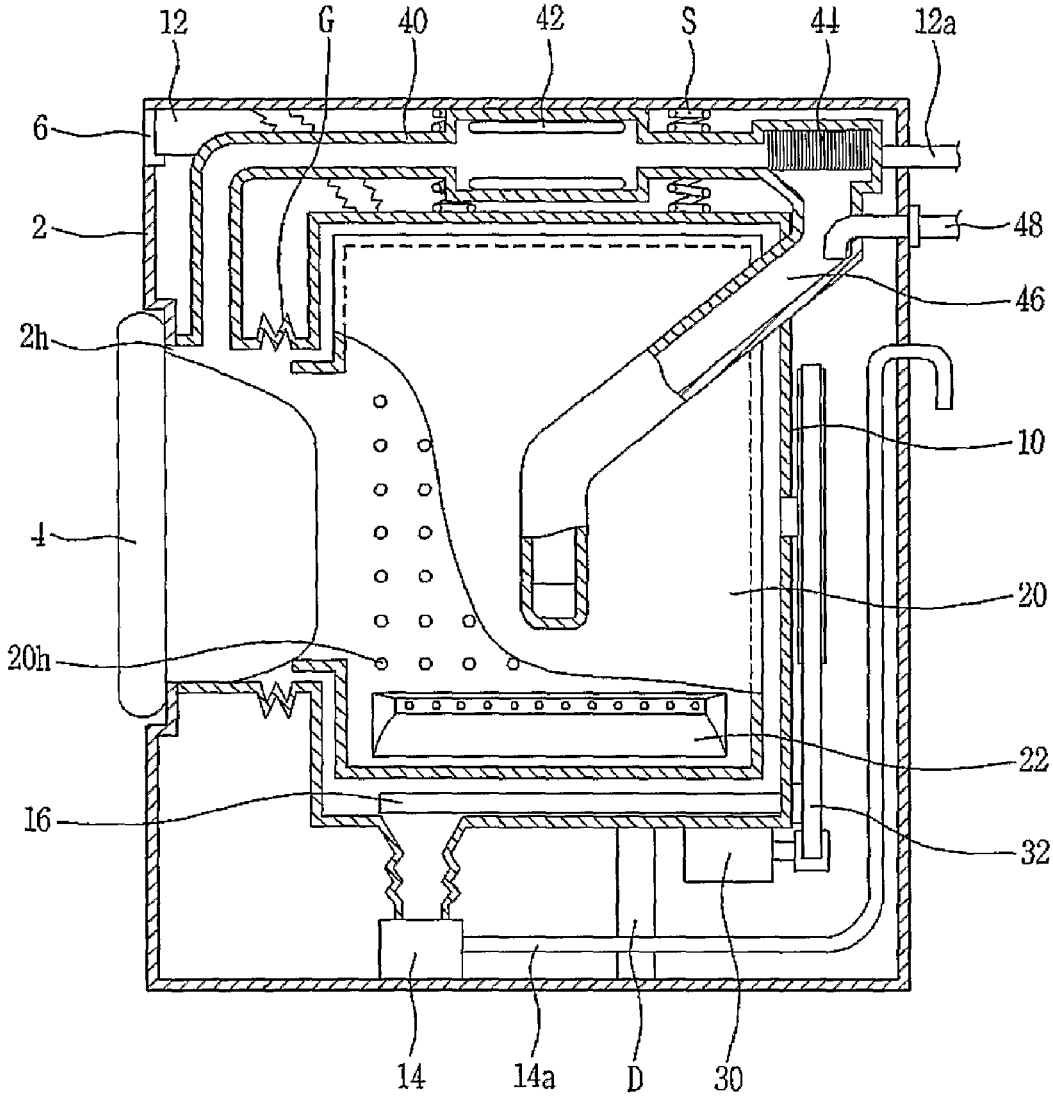

FIGS. 1 and 2 illustrate a first example of a washing machine to which a removing method of smells according to the present invention is applicable.

In a drum type washing machine according to a preferred embodiment of the present invention, as illustrated in FIGS. 1 and 2, an inlet **2*h* is formed at a casing 2 so that the laundry can be put in and out therethrough, a door 4 is installed at the inlet 2*h* to be openable and closable, a tub 10 is installed in the casing 2 to hang thereon, a drum 20 is rotatably installed inside the tub 10, a driving motor 30 is installed at one side of the tub 10, for driving the drum 20, a drying duct 40 and a condensing duct 46 connecting the top and bottom ends of the tub 10 are installed outside the tub 10, for supplying the hot air into the drum 20, and a steam generator 50 connected to a water supply passage 12*a* is installed at the upper portion of the tub 10, for supplying the steam into the drum 20**.

In more detail, a control board (not shown) is built in the front upper portion or the top rear portion of the casing 2, and a control panel 6 provided with various buttons (not shown) for controlling the operation of the washing machine is installed at the outer portion of the casing 2.

The inlet **2*h* through which the laundry is put in and out is formed at the front center portion of the casing 2. A housing space is defined inside the inlet 2*h*, for housing various components. The tub 10 is formed in a cylindrical shape to hang on the inner top face of the casing 2 by a plurality of springs S and to be supported on the inner bottom face of the casing 2 by a plurality of dampers D. Even if vibration is transferred to the casing 2**, it is buffered by the springs S and the dampers D.

The tub 10 is connected to the inlet **2*h* of the casing 2 by a gasket G. When the door 4 closes the inlet 2*h* of the casing 2, the door 4** is engaged with the inner portion of the gasket G, to prevent the leakage of wash water.

Additionally, the water supply passage **12*a* is connected to the upper portion of the tub 10, for supplying the wash water. A water supply valve (not shown) for controlling water supply and a detergent box assembly 12 for storing a detergent are installed on the water supply passage 12*a*, for supplying the wash water and the detergent into the tub 10** at the same time.

Meanwhile, a drainage pump 14 and a drainage passage **14*a* are connected to the lower portion of the tub 10, for discharging the wash water, and a washing heater 16 is built in the inner bottom face of the tub 10, for heating the wash water supplied into the tub 10. The water supply valve, the drainage pump 14 and the washing heater 16** can be controlled by a washing program prestored in the control board or control signals transmitted by the buttons.

The drum 20 is rotatably installed inside the tub 10 in a cylindrical shape, for containing the laundry or objects to be smell-removed. A plurality of communication holes **20*h* through which the wash water passes are formed at the drum 20, and the driving motor 30 is connected to the back of the drum 20**.

Three lifts 22 are installed on the inner wall face of the drum 20 at predetermined intervals to protrude in the inward direction. When the drum 20 is rotated, the laundry is lifted in a hooked state on the lifts 22 and dropped by the gravity, to thereby obtain a beating washing effect.

The driving motor 30 can be installed at the lower portion of the tub 10 and belt connected 32 to a pulley connected to the drum 20. Alternatively, the driving motor 30 can be installed at the rear center portion of the tub 10 and directly connected to a rotation shaft connected to the drum 20.

The drying duct 40 and the condensing duct 46 are installed at the outer top and bottom ends of the tub 10, respectively. The drying duct 40 is place horizontally and connected to the upper portion of the leading end of the tub 10, and the condensing duct 46 is placed vertically and connected to the bottom end of one side of the tub 10.

In more detail, a drying heater 42 and a blowing fan 44 are installed inside the drying duct 40, for supplying and circulating the hot air in the drum 20. In the meantime, a condensation water supply nozzle 48 and a condensation water supply valve (not shown) are installed inside the condensing duct 46, for supplying the condensation water for removing the moisture from the circulated air.

The drying heater 42, the blowing fan 44 and the condensation water supply valve can be controlled by the washing program prestored in the control board or the control signals transmitted by the buttons.

For example, only the blowing fan 44 is operated to supply low temperature wind into the drum 20 for cooling, or the drying heater 42 and the blowing fan 44 are operated to supply high temperature hot air into the drum 20. Besides, the condensation water supply valve is open. As soon as the high temperature hot air is supplied and circulated in the drum 20, the moisture is condensed by the condensation water and removed, to thereby perform a drying.

The steam generator 50 is connected to the water supply passage 12*a* and supplied with water. The steam generated by the steam generator 50 is injected into the drum 20 through an injection nozzle 56 inserted into the upper portion of the leading end of the tub 10. Preferably, the end of the injection nozzle 56 is placed in the tub 10 toward the inside of the drum 20.

The steam generator 50 is connected to the water supply passage 12*a* different from that of the detergent box assembly 12. Alternatively, the steam generator 50 can be connected to the same water supply passage 12*a* as that of the detergent box assembly 12 to be supplied with the wash water passing through the detergent box assembly 12. This operation is also controlled by the washing program prestored in the control board.

In more detail, in the steam generator 50, a heater (not shown) is built in a kind of hermetic container. An inflow valve 52 and an outflow valve 54 are installed at the parts of the steam generator 50 connected to the water supply passage 12*a* and the injection nozzle 56, respectively. In addition, various safety devices may be provided at the steam generator 50.

Therefore, in the drum type drying/washing machine with the above configuration, the operations of the various components are controlled according to the washing program or smell removing program previously input to the control board, for executing a general washing mode, an ironing mode, a boiling mode, a drying mode, a smell removing mode, etc. Such various modes can be selected and controlled through the various buttons on the side of the control panel 6.

Figure 3:
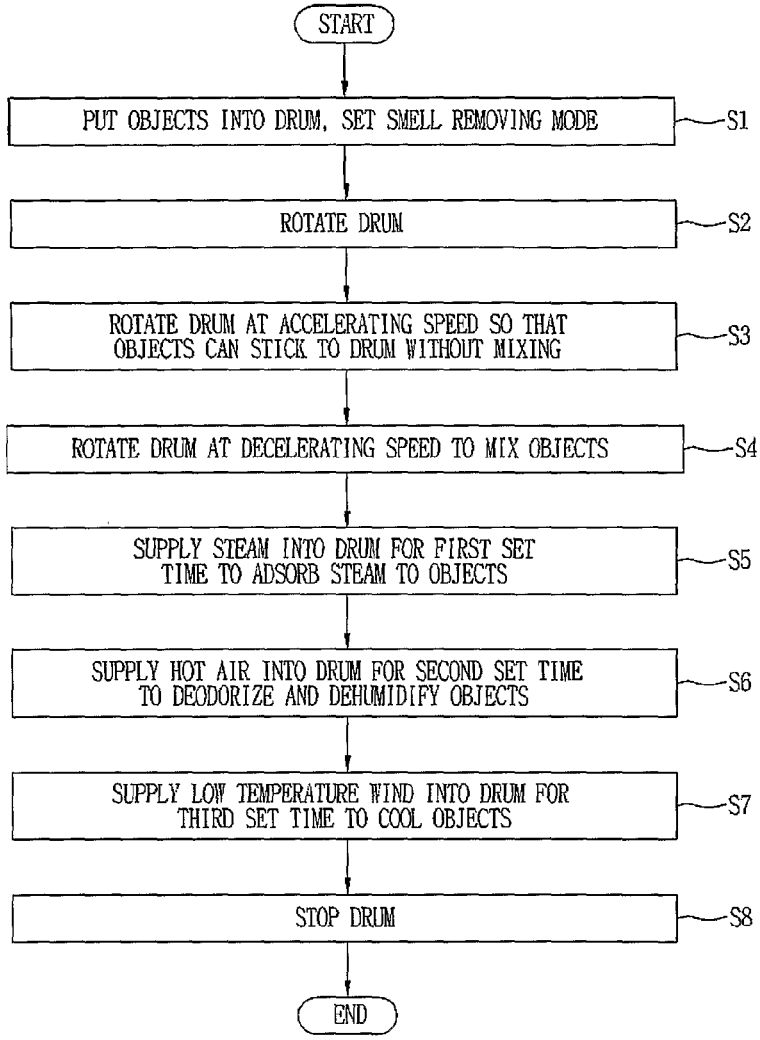
FIG. 3 illustrates a removing method of smells in the washing machine of FIGS. 1 and 2 in accordance with a first embodiment of the present invention

FIG. 3 illustrates a removing method of smells in the washing machine of FIGS. 1 and 2 in accordance with a first embodiment of the present invention. The removing method of the smells in the washing machine with the above configuration will now be explained with reference to FIG. 3.

In a first step, the objects to be smell-removed are put into the drum 20, and the smell removing mode is set (refer to S1).

Preferably, the objects to be smell-removed include fibers such as shoes, clothes, curtains and sporting goods. After the door 4 is open, the objects are put into the drum 20 through the inlet 2*h*.

The user sets the smell removing mode by using the button on the side of the control panel 6. After the smell removing mode is set, the operations of the various components are controlled according to the smell removing program previously input to the control board.

In a second step, if the smell removing mode is set in the first step, the drum 20 is rotated at a low speed, and the hot air is supplied into the drum 20 for a first set time, to perform deodorization and dehumidification (refer to S2, S1 and S4).

While the smell removing mode is executed, the drum 20 is rotated at a low speed below 1 G by the driving motor 30, and the lifts 22 repeatedly lift and drop the objects to mix the objects, thereby increasing the deodorization and dehumidification effects. Here, 1 G representing the speed of the drum means a spinning speed, namely, a rotation speed in a spinning state in which the objects stick to the drum because the centrifugal force is greater than the gravity due to the rotation of the drum. 1 G is about 60 rpm.

The process of supplying the hot air into the drum 20 will now be described in more detail. The drying heater 42 and the blowing fan 44 are operated to supply the hot air from the drying duct 40 to the tub 10. A forcible flow is generated inside the drum 20 formed in the tub 10, so that smell factors and moisture contained in the objects are mixed with the air and exhausted. Here, the air can be introduced into the condensing duct 46 and recirculated, or discharged to the outside through a special hole.

As the drum 20 is rotated, the smell factors and moisture can be separated from the objects due to the centrifugal force, passed through the communication holes 20*h* of the drum 20, and exhausted.

At the same time, the condensation water supply valve is open, so that the condensation water passes through the condensation water supply nozzle 48 and flows along the inner wall of the condensing duct 46. When the air containing the steam contacts the condensation water, the steam of the air is condensed and removed and the dried air is circulated along the drying duct 40, to thereby perform the dehumidification.

The condensation water introduced into the condensing duct 46 is transferred to the lower portion of the tub 10, and discharged to the outside through the drainage pump 14.

The forcible flow can be generated inside the drum 20 and the air can be exhausted from the drum 20 by various configurations and operations, such as supplying the hot air into the drum 20 by the drying heater 42 and the blowing fan 44, and exhausting the air from the drum 20 by the drainage pump 14. As a result, the deodorization can be carried out.

In a third step, after the hot air supply is finished in the second step, the steam is injected into the drum 20 for a second set time to be adsorbed to the objects (refer to S5).

The process of injecting the steam into the drum 20 will now be explained in more detail. The steam generator 50 is operated. The water supply valve 52 is open to supply water from the water supply passage 12*a*. At the same time, the heater is operated to generate the steam. The discharge valve 54 is open to inject the steam into the drum 20 along the injection nozzle 56.

The water supply valve 52 and the heater can be operated in advance to generate the steam. As soon as the discharge valve 54 is open, the generated steam is injected into the drum 20 through the injection nozzle 56. Here, a small amount of steam is injected to slightly wet the objects.

While the drum 20 is rotated, the lifts 22 lift and drop the objects to mix the objects. Therefore, the steam is evenly adsorbed to the objects. When the high temperature steam is adsorbed to the objects, the smell factors and the water soluble dirts are dissolved. Further, a sterilization function using the steam is obtained.

In a fourth step, after the steam injection is finished in the third step, the hot air with a temperature lowered by degrees is supplied into the drum 20 for a third set time, to perform the deodorization and dehumidification (refer to S6).

The process of perfuming the deodorization and dehumidification by supplying the hot air into the drum 20 is identical to the process of the second step, and thus detailed explanations thereof are omitted. The steam adsorbed to the objects and the smell factors and the water soluble dirts contained in the steam are exhausted from the drum 20 with the hot air. Further, an ironing function using the steam and the hot air is carried out.

While the hot air with a temperature lowered by degrees is supplied into the drum 20, the current supplied to the drying heater 42 can be lowered to reduce the heating value of the drying heater 42, or the current supplied to the blowing fan 44 can be lowered to reduce the blast volume of the blowing fan 44. As a result, the dehumidification/drying can be sufficiently performed and the electric consumption can be reduced.

In consideration of the energy saving efficiency, it is more preferable to reduce the heating value of the drying heater 42 at intervals of a set time.

In a fifth step, after the hot air supply is finished in the fourth step, low temperature wind is supplied into the drum 20 for a fourth set time, to perform a cooling. Thereafter, the rotation of the drum 20 is stopped, and the objects are taken out from the drum 20 (refer to S7 and S8).

The process of supplying the low temperature wind into the drum 20 will now be described in more detail. The drying heater 42 is stopped, but the blowing fan 44 is operated to supply the low temperature wind from the drying duct 40 to the tub 10. A forcible flow is generated inside the tub 10 and the drum 20, cools the high temperature objects by heat exchange, and is exhausted.

The air cooling the high temperature objects in the drum 20 can be introduced into the condensing duct 46 and recirculated, or discharged to the outside through a special hole.

While the drum 20 is rotated, the lifts 22 lift and drop the objects to evenly mix the objects. Accordingly, the objects can be rapidly cooled by the low temperature wind supplied from the outside. After the drum 20 is completely stopped, the user can safely take out the cooled objects.

Figure 4:
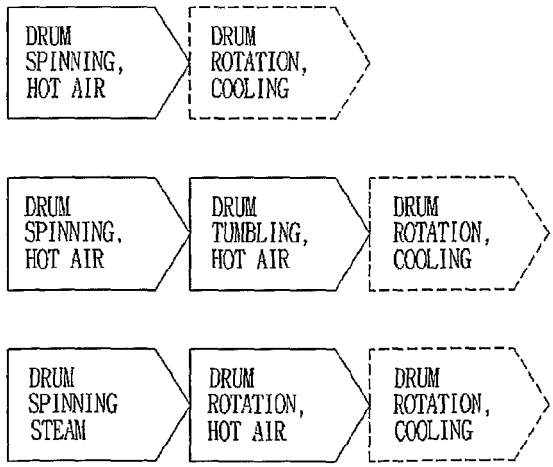
FIG. 4 illustrates a removing method of smells in the washing machine of FIGS. 1 and 2 in accordance with a second embodiment of the present invention.

FIG. 4 illustrates a removing method of smells in the washing machine of FIGS. 1 and 2 in accordance with a second embodiment of the present invention. The removing method of the smells according to this embodiment is embodied by supplying the hot air in a state where the drum is rotated in a spinning state, by supplying the steam in a state where the drum is rotated in the spinning state and supplying the hot air in a state where the drum is rotated in a tumbling state, or by supplying the steam in a state where the drum is rotated in the spinning state and supplying the hot air in a state where the drum is rotated. Preferably, after the above procedure, the removing method of the smells includes a process of cooling the objects by rotating the drum or supplying non-heated wind during the rotation of the drum.

Figure 5:
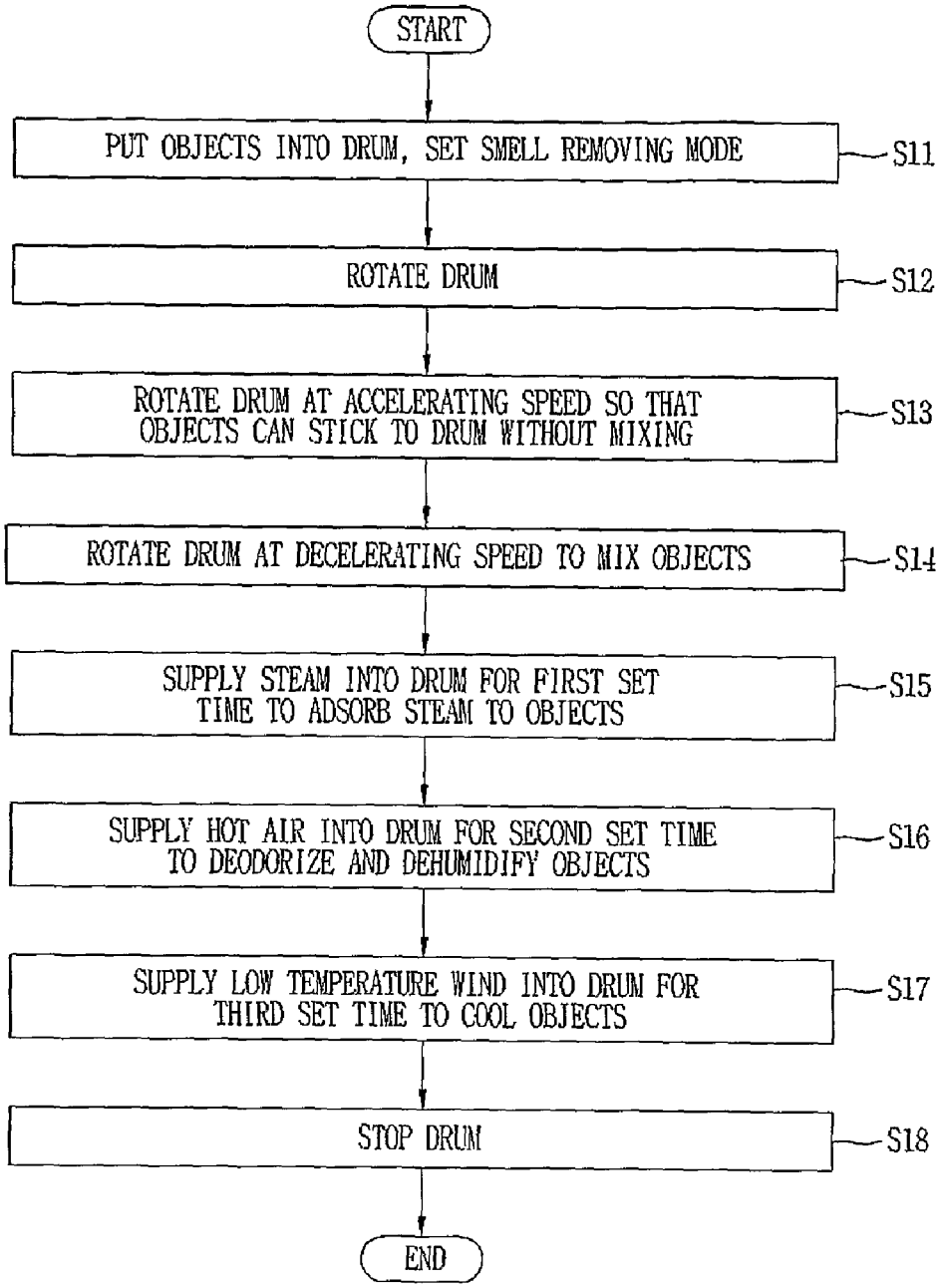
FIG. 5 illustrates a removing method of smells in the washing machine of FIGS. 1 and 2 in accordance with a third embodiment of the present invention.

FIG. 5 illustrates a removing method of smells in the washing machine of FIGS. 1 and 2 in accordance with a third embodiment of the present invention.

In a first step, the objects to be smell-removed are put into the drum 20, and the smell removing mode is set (refer to S11). Preferably, the objects to be smell-removed include fibers such as shoes, clothes, curtains and sporting goods. After the door 4 is open, the objects are put into the drum 20 through the inlet 2*h*. The user sets the smell removing mode by using the button on the side of the control panel 6. After the smell removing mode is set, the operations of the various components are controlled according to the smell removing program previously input to the control board.

In a second step, the drum 20 is rotated at an accelerating speed for a set time so that the objects to be smell-removed cannot be mixed with each other but stick to the inside of the drum 20. Here, the objects are deodorized respectively (refer to S12 and S13). If the driving motor 30 rotates the drum 20 over 1 G, since the centrifugal force is greater than the gravity due to the rotation of the drum 20, the objects to be smell removed are rotated in the spinning state, namely, in the sticking state to the drum 20, and the smell factors are sent in the radial direction and discharged, to thereby remove the smells. In addition, as the objects to be smell-removed are rotated in the sticking state to the inside of the drum 20, the objects are not mixed with each other, which prevents smell transfer from an object with a relatively strong smell to an object with a relatively weak smell, or smell transfer between objects with different smells. Meanwhile, the hot air can be supplied in at least part of the rotation of the drum 20 to efficiently remove the smells.

In a third step, the drum 20 is decelerated and rotated, and the steam is supplied into the drum 20 for a first set time to be adsorbed to the objects (refer to S14 and S15). If the driving motor 30 rotates the drum 20 below 1 G, the drum 20 is rotated at a decelerating speed, so that the centrifugal force becomes smaller than the gravity. That is, the drum 20 is rotated in the tumbling state, so that the lifts 22 lift and drop the objects to mix the objects with each other. As soon as the drum 20 is rotated in the tumbling state, the steam is injected into the drum 20. The process of injecting the steam into the drum 20 will now be explained in more detail. The steam generator 50 is operated. The water supply valve 52 is open to supply water from the water supply passage 12*a*. At the same time, the heater is operated to generate the steam. The discharge valve 54 is open to inject the steam into the drum 20 along the injection nozzle 56. The water supply valve 52 and the heater can be operated in advance to generate the steam. As soon as the discharge valve 54 is open, the generated steam is injected into the drum 20 through the injection nozzle 56. Here, a small amount of steam is injected to slightly wet the objects. While the drum 20 is rotated in the tumbling state, the objects in the drum 20 are mixed with each other, so that the steam is evenly adsorbed to the objects. When the high temperature steam is adsorbed to the objects, smell factors and water soluble dirts are dissolved. Further, a sterilization function using the steam is obtained.

In a fourth step, after the steam injection is finished in the third step, the hot air is supplied into the drum 20 for a second set time, to perform deodorization and dehumidification (refer to S16). While the hot air is supplied into the drum 20, the drum 20 is preferably rotated in the tumbling or spinning state. The process of supplying the hot air into the drum 20 will now be described in more detail. The drying heater 42 and the blowing fan 44 are operated to supply the hot air from the drying duct 40 to the tub 10. A forcible flow is generated inside the tub 10 and the drum 20, so that the smell factors and moisture contained in the objects are mixed with the air and exhausted. Here, the air can be introduced into the condensing duct 46 and recirculated, or discharged to the outside through a special hole. As the drum 20 is rotated, the smell factors and moisture can be separated frau the objects due to the centrifugal force, passed through the communication holes 20*h* of the drum 20, and exhausted. That is, the smells are secondarily removed. At the same time, the condensation water supply valve is open, so that the condensation water passes through the condensation water supply nozzle 48 and flows along the inner wall of the condensing duct 46. When the air containing the steam contacts the condensation water, the steam of the air is condensed and removed and the dried air is circulated along the drying duct 40, to thereby perform the dehumidification. The condensation water introduced into the condensing duct 46 is transferred to the lower portion of the tub 10, and discharged to the outside through the drainage pump 14. As described above, the forcible flow can be generated inside the d rum 20 and the air can be exhausted from the drum 20 by various configurations and operations, such as supplying the hot air into the drum 20 by the drying heater 42 and the blowing fan 44, and exhausting the air from the drum 20 by the drainage pump 14. As a result, the deodorization can be carried out.

In the meantime, the smell removing mode can be set to be executed in the fourth step, after the steam is supplied directly in the spinning state of S13.

In a fifth step, low temperature wind is supplied into the drum 20 for a third set time, to perform a cooling. Thereafter, the rotation of the drum 20 is stopped, and the objects are taken out from the drum 20 (refer to S17 and S18). The process of supplying the low temperature wind into the drum 20 will now be described in more detail. The drying heater 42 is stopped, but the blowing fan 44 is operated to supply the low temperature wind from the drying duct 40 to the tub 10. A forcible flow is generated inside the tub 10 and the drum 20, cools the high temperature objects by heat exchange, and is exhausted. The air cooling the high temperature objects in the drum 20 can be introduced into the condensing duct 46 and recirculated, or discharged to the outside through a special hole. While the drum 20 is rotated, the lifts 22 lift and drop the objects to evenly mix the objects. Accordingly, the objects can be rapidly cooled by the low temperature wind supplied from the outside. After the drum 20 is completely stopped, the user can safely take out the cooled objects.

Figure 6:
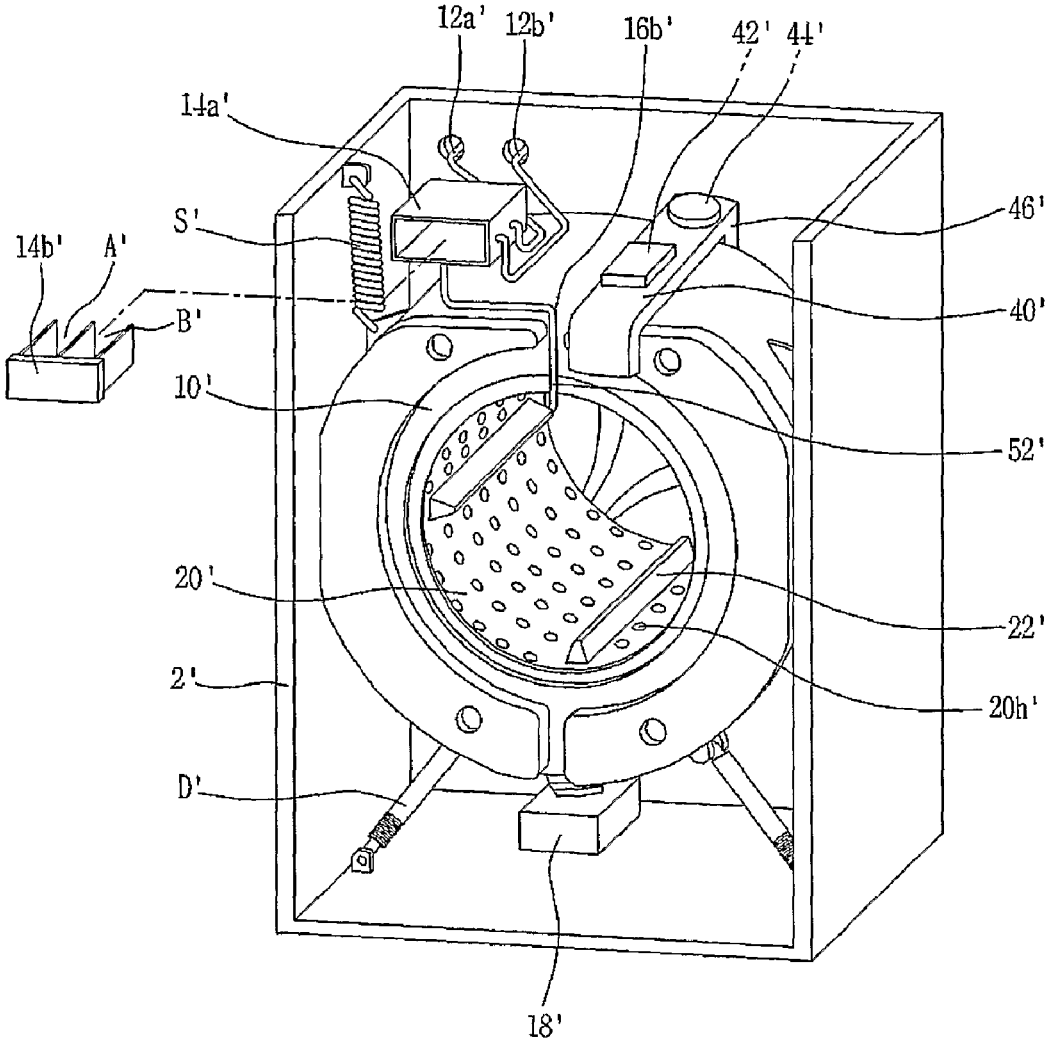
FIGS. 6 to 8 illustrate a second example of a washing machine to which a removing method of smells according to the present invention is applicable.
Figure 7:
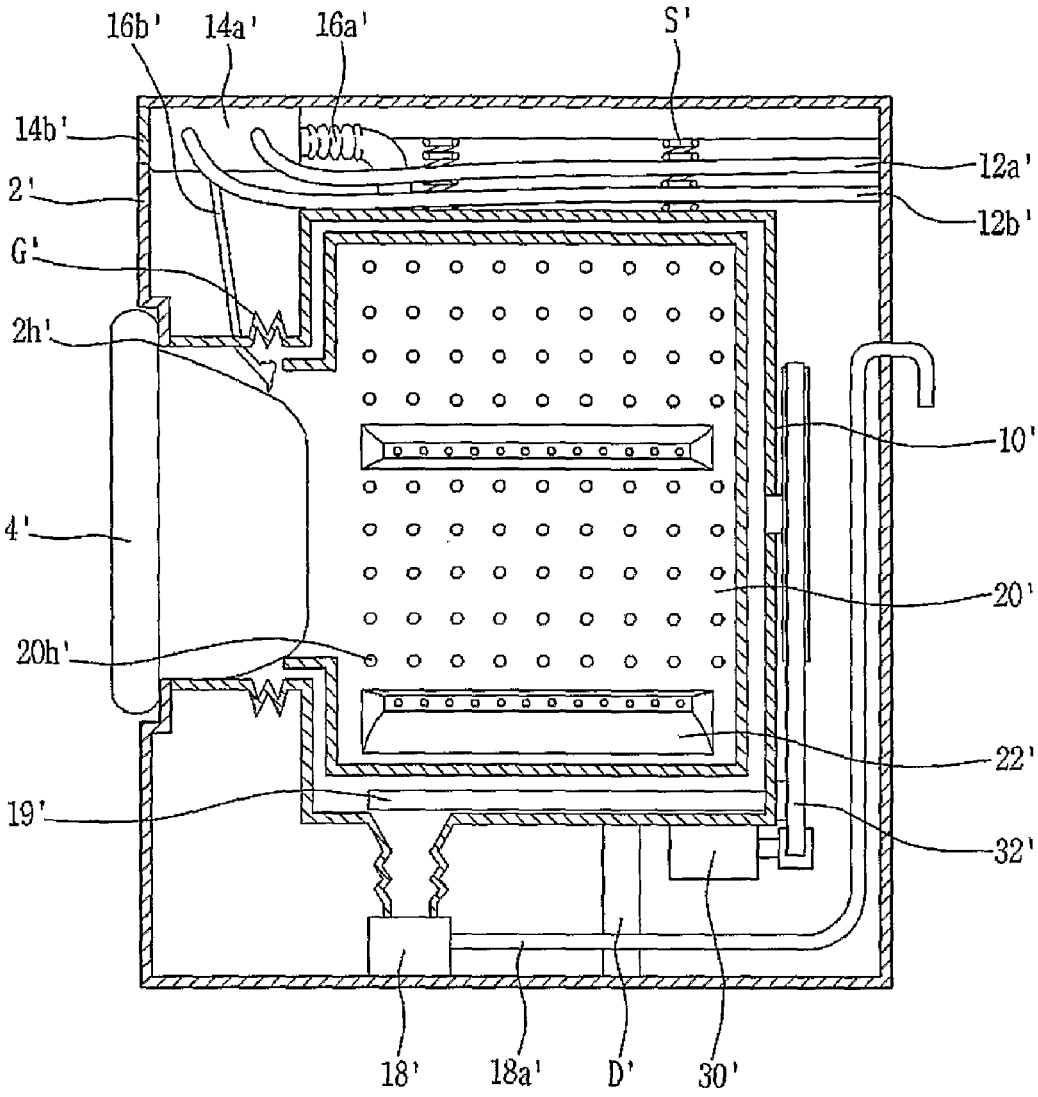
Figure 8:
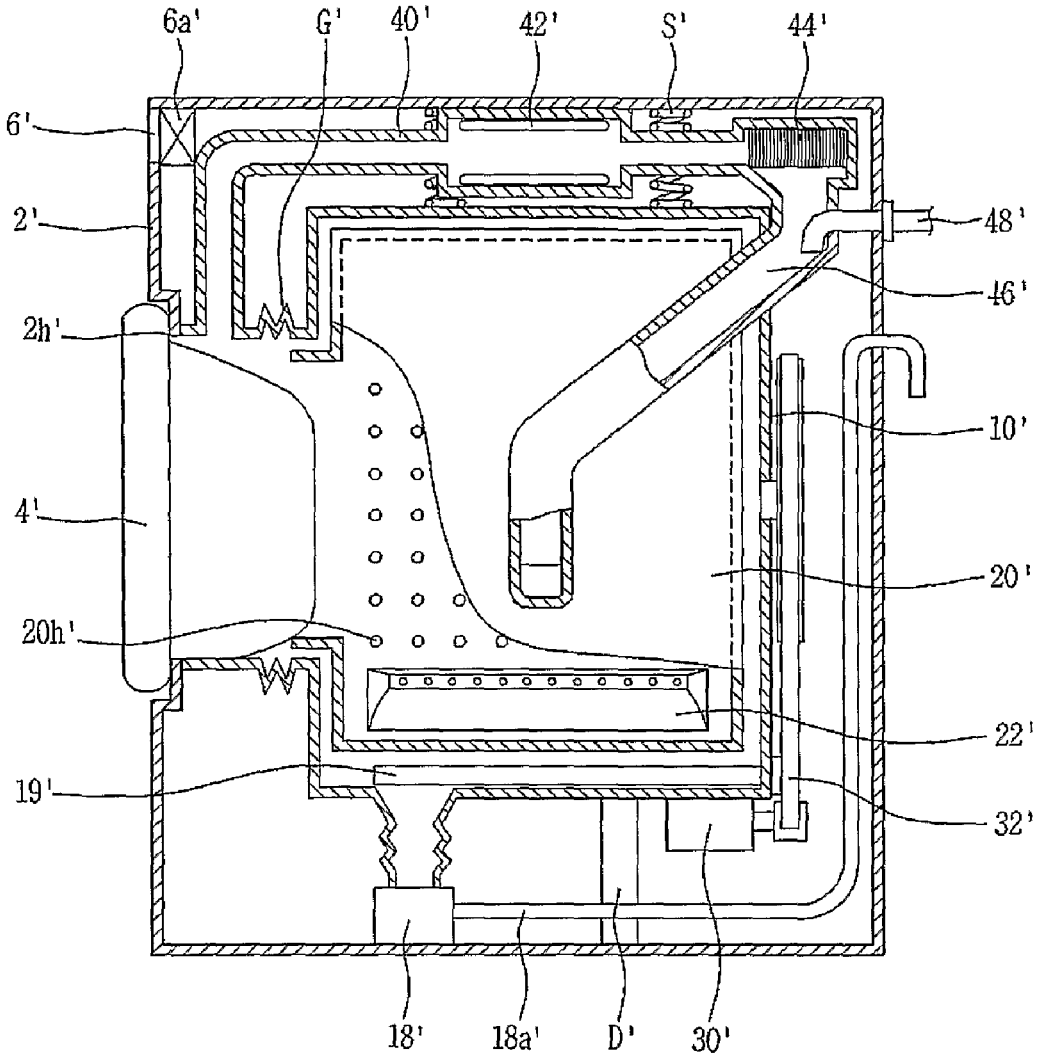

FIGS. 6 to 8 illustrate a second example of a washing machine to which a removing method of smells according to the present invention is applicable. In the washing machine, an inlet 2*h*' is formed at a casing 2' so that the laundry can be put in and out therethrough, a door 4' is installed at the inlet 2*h*' to be openable and closable, a tub 10' is installed in the casing 2' to hang thereon, a drum 20' is rotatably installed inside the tub 10', a driving motor 30' is installed at one side of the tub 10', for driving the drum 20', a detergent box assembly 14*a*' and 14*b*' connected to one or more water supply passages 12*a*' and 12*b*' is installed at the upper portion of the tub 10', for selectively supplying detergent and wash water or deodorant into the drum 20', and a drying duct 40' and a condensing duct 46' connecting the top and bottom ends of the tub 10' are installed outside the tub 10', for supplying the hot air into the drum 20'.

In more detail, a control panel 6' is installed at the front upper portion or the top rear portion of the casing 2', and a control board 6*a*' is installed inside the control panel 6'. Various buttons (not shown) for controlling the operation of the washing machine are provided at the outer portion of the control panel 6'.

The inlet 2*h*' through which the laundry is put in and out is formed at the front center portion of the casing 2'. A housing space is defined inside the inlet 2*h*', for housing various components.

The tub 10' is formed in a cylindrical shape to hang on the inner top face of the casing 2' by a plurality of springs S' and to be supported on the inner bottom face of the casing 2' by a plurality of dampers D'. Even if vibration is transferred to the casing 2', it is buffered by the springs S' and the dampers D'.

The tub 10' is connected to the inlet 2*h*' of the casing 2' by a gasket G'. When the door 4' closes the inlet 2*h*' of the casing 2', the door 4' is engaged with the inner portion of the gasket G', to prevent the leakage of wash water.

Additionally, as described above, the one or more water supply passages 12*a*' and 12*b*' and the detergent box assembly 14*a*' and 14*b*' are connected at the upper portion of the tub 10', for supplying the wash water with the detergent or the deodorant.

In more detail, the detergent box assembly 14*a*' and 14*b*' includes a detergent box housing 14*a*' fixedly installed inside the casing 2', and a detergent box 14*b*' detachably installed in the detergent box housing 14*a*'. The detergent box 14*b*' can be partitioned off into a detergent space A' for containing a detergent, a bleach and a fabric softener, and a deodorant space B' for containing a powder/liquid phase deodorant, or can include a detergent box (not shown) and a deodorant box (not shown).

The two water supply passages 12*a*' and 12*b*' are connected to the detergent box housing 14*a*', for supplying the wash water to the detergent space A' and the deodorant space B' of the detergent box 14*b*', respectively. Preferably, water supply valves (not shown) for controlling water supply are installed on the water supply passages 12*a*' and 12*b*', respectively.

Particularly, a water supply bellows 16*a*' is installed at one part of the detergent box housing 14*a*' to communicate with the detergent space A' of the detergent box 14*b*', and an injection nozzle 16*b*' is installed at another part of the detergent box housing 14*a*' to communicate with the deodorant space B' of the detergent box 14*b*'.

Preferably, the water supply bellows 16*a*' is installed to communicate with the top end of the tub 10', but the injection nozzle 16*b*' is installed inside the gasket G' toward the drum 20'.

As wash water of a relatively high flow rate is supplied in the washing mode, the water supply bellows 16*a*' has a large diameter. On the contrary, as water is supplied with a deodorant of a relatively low flow rate in the smell removing mode, the injection nozzle 16*b*' has a small diameter. Although the deodorant is supplied with water, it is supplied at a small amount to slightly wet the objects to be smell-removed.

Meanwhile, a pump 18' and a drainage passage 18*a*' are connected to the lower portion of the tub 10', for discharging the wash water, and a washing heater 19' is built in the inner bottom face of the tub 10', for heating the wash water supplied into the tub 10'

The water supply valve, the pump 18' and the washing heater 19' can be controlled by a washing program prestored in the control board 6*a*' or control signals transmitted by the buttons.

The drum 20' is rotatably installed inside the tub 10' in a cylindrical shape, for containing the laundry or the objects to be smell-removed. A plurality of communication holes 20*h*' through which the wash water passes are formed at the drum 20', and the driving motor 30' is connected to the back of the drum 20'.

Three lifts 22' are installed on the inner wall face of the drum 20' at predetermined intervals to protrude in the inward direction. When the drum 20' is rotated, the laundry is lifted in a hooked state on the lifts 22' and dropped by the gravity, to thereby obtain a beating washing effect. The driving motor 30' can be installed at the lower portion of the tub 10' and belt-connected 32' to a pulley connected to the drum 20'. Alternatively, the driving motor 30' can be installed at the rear center portion of the tub 10' and directly connected to a rotation shaft connected to the drum 20'.

The drying duct 40' and the condensing duct 46' are installed at the outer top and bottom ends of the tub 10', respectively. The driving duct 40' is placed horizontally and connected to the upper portion of the leading end of the tub 10', and the condensing duct 46' is placed vertically and connected to the bottom end of one side of the tub 10'.

In more detail, a drying heater 42' and a blowing fan 44' are installed inside the drying duct 40', for supplying and circulating the hot air in the drum 20'. In the meantime, a condensation water supply nozzle 48' and a condensation water supply valve (not shown) are installed inside the condensing duct 46', for supplying the condensation water for removing the moisture from the circulated air.

The drying heater 42', the blowing fan 44' and the condensation water supply valve can be controlled by the washing program prestored in the control board 6*a'* or the control signals transmitted by the buttons.

For example, only the blowing fan 44' is operated to supply low temperature wind into the drum 20' for cooling, or the drying heater 42' and the blowing fan 44' are operated to supply high temperature hot air into the drum 20'. Besides, the condensation water supply valve is open. As soon as the high temperature hot air is supplied and circulated in the drum 20', the moisture is condensed by the condensation water and removed, to thereby perform a drying.

Meanwhile, the end of the injection nozzle 16*b'* can be connected to the inside of the drying duct 40'. In this case, although the deodorant is injected into the drying duct 40' through the injection nozzle 16*b'*, since the blowing fan 44' is driven, the deodorant can be relatively farther transferred into the drum 20'. The same effect can be obtained by connecting the end of the injection nozzle 16*b'* to the inside of the condensing duct 46'.

In the drum type drying/washing machine with the above configuration, the operations of the various components are controlled according to the washing program or smell removing program previously input to the control board 6*a'*, for executing a general washing mode, an ironing mode, a boiling mode, a drying mode, a smell removing mode, etc. Such various modes can be selected and controlled through the various buttons on the side of the control panel 6'.

Figure 9:
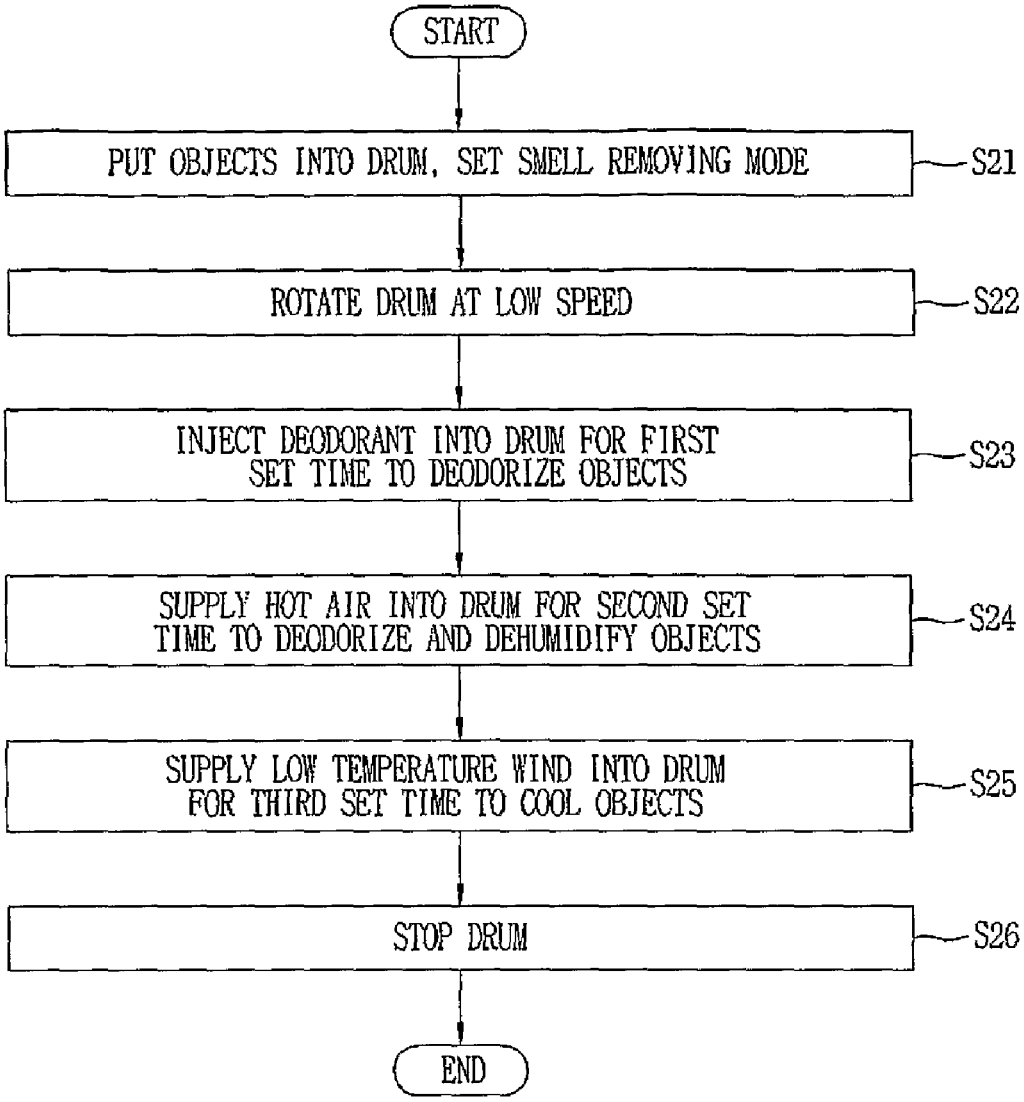
FIG. 9 illustrates a removing method of smells in the washing machine of FIGS. 6 to 8 in accordance with a first embodiment of the present invention.

FIG. 9 illustrates a removing method of smells in the washing machine of FIGS. 6 to 8 in accordance with a first embodiment of the present invention. In a first step, the objects to be smell-removed are put into the drum 20', and the smell removing mode is set (refer to S21). Preferably, the objects to be smell-removed include fibers such as shoes, clothes, curtains and sporting goods. After the door 4' is open, the objects are put into the drum 20' through the inlet 2*h'*. The user sets the smell removing mode by using the button on the side of the control panel 6'. After the smell removing mode is set, the operations of the various components are controlled according to the smell removing program previously input to the control board 6*a'*.

In a second step, the drum 20' is rotated at a low speed, and the deodorant is injected into the drum 20' for a first set time, to perform deodorization (refer to S22 and S23). While the smell removing mode is executed, the drum 20' is rotated at a low speed below 1 G by the driving motor 30', and the lifts 22' repeatedly lift and drop the objects to mix the objects. The process of supplying the deodorant into the drum 20' will now be described in more detail. The water supply passage 12*b'* communicating with the deodorant space B' of the detergent box 14*b'* is open, so that water is supplied through the water supply passage 12*b'*, mixed with the deodorant previously put into the deodorant space B' of the detergent box 14*b'*, and injected into the drum 20' along the injection nozzle 16*b'*. If the end of the injection nozzle 16*b'* is positioned inside the gasket G', the deodorant is injected directly into the objects in the drum 20'. If the end of the injection nozzle 16*b'* is positioned inside the drying duct 40', the blowing fan 44' is driven, so that the deodorant is passed through the drying duct 40' and evenly injected into the objects in the drum 20'. As the objects to be smell-removed are rotated with the drum 20' inside the drum 20', the deodorant can be evenly injected into the objects. Accordingly, the deodorant can improve the deodorization effect by the neutralization with smell factors of the objects to be smell-removed.

Figure 10:
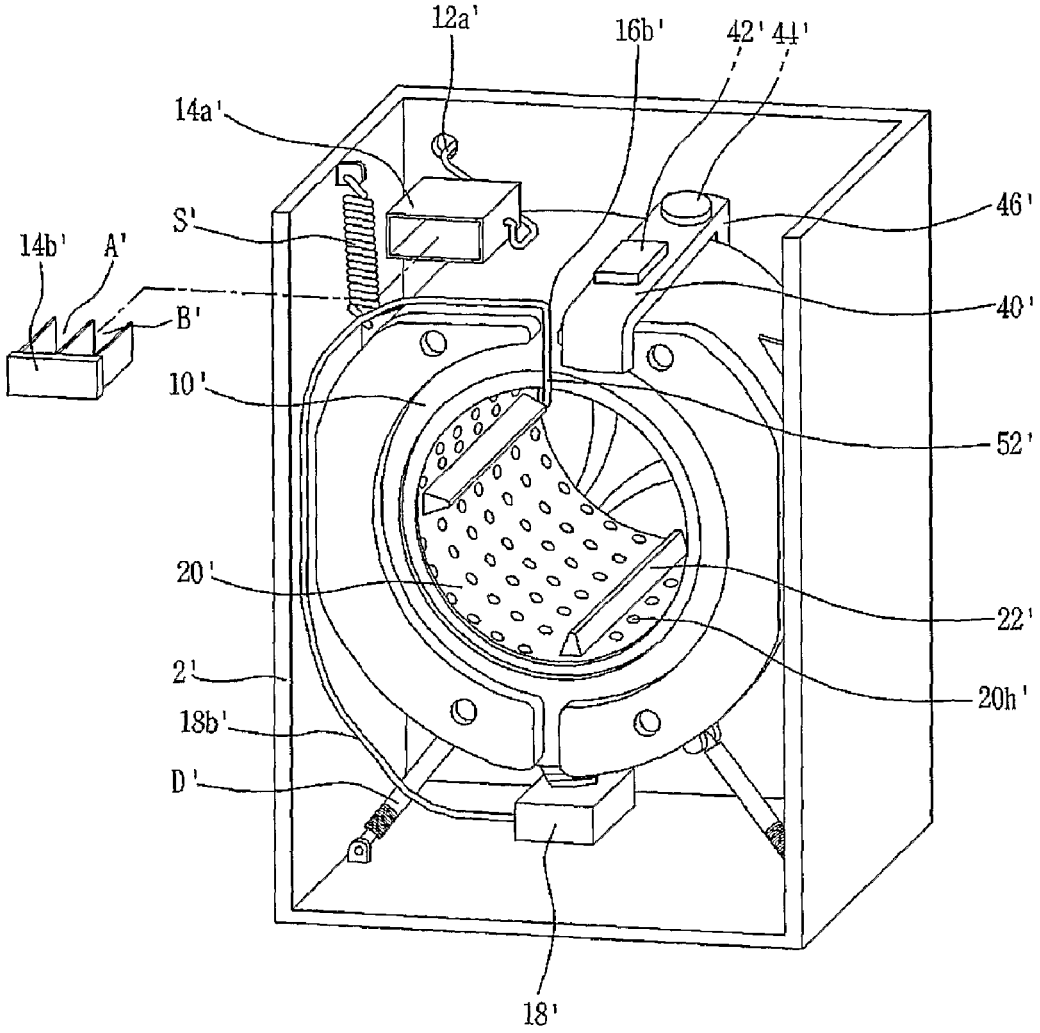
FIG. 10 illustrates a third example of a washing machine to which a removing method of smells according to the present invention is applicable.

As described above, the water supply passage 12*b'*, the deodorization space B' and the injection nozzle 16*b'* are used to inject the deodorant. However, according to the present invention, the general washing machine can inject the deodorant without using such means. That is, as shown in FIG. 10, in a washing machine provided with a pump 18' and a circulation passage 18*b'*, when a deodorant is put into one of detergent spaces A' or a deodorant space and a smell removing mode is executed, water is supplied to one of the detergent spaces A' or the deodorant space B' through a water supply passage 12*a'*. Therefore, the deodorant is diluted with water and supplied into a tub 10'. The diluted deodorant is sprayed onto objects in a drum 20' through the circulation passage 18*b'* by using the pump 18', and adsorbed to the objects.

In a third step, the hot air is supplied into the drum 20' for a second set time, to perform deodorization and dehumidification (refer to S24). When the deodorant neutralizes or dissolves the smell factors of the objects to be smell-removed in the drum 20', the smell factors and the deodorant are left on the objects. The hot air is supplied to exhaust the smell factors and the deodorant from the drum 20' by generating a forcible flow in the drum 20', and to dry the deodorant slightly permeating into the objects. The process of supplying the hot air into the drum 20' will now be described in more detail. The drying heater 42' and the blowing fan 44' are operated to supply the hot air from the drying duct 40' to the tub 10'. The forcible flow is generated inside the tub 10' and the drum 20', so that the smell factors and the deodorant contained in the objects are mixed with the air and exhausted. Here, the air can be introduced into the condensing duct 46' and recirculated, or discharged to the outside through a special hole. As the drum 20' is rotated, the smell factors and the deodorant can be separated from the objects due to the centrifugal force, passed through the communication holes 20*h'* of the drum 20', and exhausted. At the same time, the condensation water supply valve is open, so that the condensation water passes through the condensation water supply nozzle 48' and flows along the inner wall of the condensing duct 46'. When the air containing the deodorant contacts the condensation water, the deodorant and the moisture of the air are condensed and removed and the dried air is circulated along the drying duct 40', to thereby remove the deodorant and perform the dehumidification. The condensation water introduced into the condensing duct 46' is transferred to the lower portion of the tub 10', and discharged to the outside through the drainage pump 14'. As described above, the forcible flow can be generated inside the drum 20' and the air containing the smell factors and the deodorant can be exhausted from the drum 20' by various configurations and operations, such as supplying the hot air into the drum 20' by the drying heater 42' and the blowing fan 44', and exhausting the air containing the smell factors and the deodorant from the drum 20' by the drainage pump 14'. As a result, the deodorization can be actively carried out.

In a fourth step, low temperature wind is supplied into the drum 20' for a third set time, to perform a cooling. Thereafter, the rotation of the drum 20' is stopped, and the objects are taken out from the drum 20' (refer to S25 and S26). The process of supplying the low temperature wind into the drum 20' will now be described in more detail. The drying heater 42' is stopped, but the blowing fan 44' is operated to supply the low temperature wind from the drying duct 40' to the tub 10'. A forcible flow is generated inside the tub 10' and the drum 20', cools the high temperature objects by heat exchange, and is exhausted. The air cooling the high temperature objects in the drum 20' can be introduced into the condensing duct 46' and recirculated, or discharged to the outside through a special hole. While the drum 20' is rotated, the lifts 22' lift and drop the objects to evenly mix the objects. Accordingly, the objects can be rapidly cooled by the low temperature wind supplied from the outside. After the drum 20' is completely stopped, the user can safely take out the cooled objects.

The drum type drying/washing machine has been described in detail on the basis of the preferred embodiments and the attached drawings of the present invention. However, the present invention is applicable to various kinds of washing machines and drying machines. It is recognized that the scope of the present invention should not be limited to these preferred embodiments and drawings but to the claims as hereinafter recited.

INDUSTRIAL APPLICABILITY

In accordance with the present invention, the removing method of the smells puts the objects to be smell-removed into the drum, and supplies the steam and the forcible flow into the drum to exhaust the smell factors. Therefore, the removing method of the smells can remove the smells sticking to the objects by using the safe material such as water and air. That is, this method is harmless to humans and provides the sterilization and ironing functions. While the drum is rotated by the driving motor, the smells are evenly removed, which reduces the troublesomeness of the user.

In accordance with the present invention, the removing method of the smells can prevent the smell transfer between the objects to be smell-removed, by preventing mixing of the objects.

In accordance with the present invention, the removing method of the smells can efficiently remove the smells without a side effect by supplying the hot air or the steam, without transferring the smells between the objects.

In accordance with the present invention, the removing method of the smells can remove the smells which cannot be removed by the general washing machine.

In accordance with the present invention, the removing method of the smells can remove the smells with high safety by exhausting the deodorant with the smells, when the deodorant is applied to the objects to be smell-removed.

The invention claimed is:

1. A method of removing smells using a rotatable drum configured to receive objects from which a smell is to be removed, a steam generator for supplying the steam into the rotatable drum, and a passage that extends to the rotatable drum to generate a forcible flow in the rotatable drum, the method comprising:

a first step of exhausting air from the rotatable drum by generating the forcible flow in the rotatable drum using the passage, comprising rotating the rotatable drum at a first speed that causes the objects received in the rotatable drum to adhere to an inner circumferential surface of the rotatable drum without mixing the objects received in the rotatable drum;

a second step of adsorbing steam generated by the steam generator into the objects received in the rotatable drum, comprising:

rotating the rotatable drum at a second speed that causes the objects received in the rotatable drum to separate from the inner circumferential surface of the rotatable drum and mix in the rotatable drum, the second speed being less than the first speed; and supplying the steam generated by the steam generator into the rotatable drum as the objects received in the rotatable drum are mixed such that the steam is adsorbed into the objects; and a third step of removing the adsorbed steam, comprising:

rotating the rotatable drum at a third speed; and supplying hot air to the rotatable drum using the passage and generating the forcible flow in the rotatable drum to remove moisture from the objects received in the rotatable drum.

2. The method of claim 1, wherein, in the first step, generating the forcible flow comprises supplying hot air to the rotatable drum through the passage.

3. The method of claim 1, further comprising a fourth step of generating the forcible flow in the rotatable drum again by supplying a flow of air having a lower temperature than that of the hot air supplied to the rotatable drum in the third step.

4. The method of claim 1, further comprising a fourth step of cooling the objects received in the rotatable drum after the step of supplying hot air to the rotatable drum to remove the adsorbed steam.

5. The method of claim 1, wherein the step of rotating the rotating drum at a third speed comprises rotating the rotatable drum at either the first speed or the second speed for a preset steam removal time.

6. The method of claim 1, wherein the first step of exhausting air from the rotatable drum by generating the forcible flow in the rotatable drum using the passage comprises:

operating a fan provided in the passage to generate the forcible flow that draws air from the rotatable drum into the passage and that forces air from the passage into the rotatable drum so as to circulate air through the rotatable drum.

7. The method of claim 6, wherein the first step of exhausting air from the rotatable drum by generating the forcible flow in the rotatable drum using the passage further comprises:

operating a heater provided in the passage so as to heat air flowing through the passage and providing heated air into the rotatable drum.

8. The method of claim 1, wherein the first step of exhausting air from the rotatable drum comprises operating a fan and a heater provided in the passage so as to draw air from the rotatable drum into the passage, heat the air as it flows through the passage, and force the heated air into the rotatable drum so as to circulate air through the rotatable drum.

9. An odor removal method for use in a laundry treatment apparatus including a rotatable drum configured to receive items to be treated therein, a steam generator configured to supply steam to the rotatable drum, and a circulation passage configured to circulate air through the rotatable drum, the method comprising:

initiating a first cycle, comprising:

rotating the rotatable drum at a first speed that causes the items received in the rotatable drum to adhere to an inner circumferential surface of the rotatable drum; and operating a fan provided in the circulation passage to draw air from the rotatable drum through the circulation passage and back into the rotatable drum so as to circulate air through the rotatable drum;

initiating a second cycle, comprising:

rotating the rotatable drum at a second speed that causes the items received in the rotatable drum to separate from the inner circumferential surface of the rotatable drum and mix in the rotatable drum, the second speed being less than the first speed; and supplying steam generated by the steam generator into the rotatable drum; and initiating a third cycle, comprising:

rotating the rotatable drum at a third speed that is greater than or equal to the second speed; and operating both the fan and a heater provided in the circulation passage and supplying hot air to the rotatable drum.

* * * * *